US005555828A

United States Patent [19]

Rowley

[11] Patent Number: 5,555,828

[45] Date of Patent: Sep. 17, 1996

[54] EMBROIDERY HOOP ATTACHMENT ASSEMBLY

[76] Inventor: Donald G. Rowley, 8367 E. Pecos Dr., #4, Prescott Valley, Ariz. 86314-4321

[21] Appl. No.: 510,770

[22] Filed: Aug. 3, 1995

Related U.S. Application Data

[63] Continuation-in-part of Ser. No. 394,900, Feb. 27, 1995, abandoned.

[51] Int. Cl.[6] ..... D05C 9/04

[52] U.S. Cl. ..... 112/103

[58] Field of Search ..... 112/103, 114, 112/119, 470.18, 102, 102.5; 38/102, 102.2; 403/292, 24, 326; 24/170

[56] References Cited

U.S. PATENT DOCUMENTS

| | | | |
|---|---|---|---|
| 2,141,294 | 12/1938 | Cardy | 112/103 |
| 2,765,581 | 10/1956 | Adler | 403/292 X |
| 3,664,288 | 5/1972 | Weidtin Von Boden et al. | 112/103 |
| 4,411,208 | 10/1983 | Nishida et al. | 112/103 |
| 4,800,629 | 1/1989 | Ikeda | 24/170 |
| 4,993,333 | 2/1991 | Moore, III. | 112/103 |
| 5,101,746 | 4/1992 | Frye | 112/114 X |
| 5,261,340 | 11/1993 | Conley, Jr. et al. | 112/114 X |
| 5,291,843 | 3/1994 | Hori | 112/103 |
| 5,353,725 | 10/1994 | Sakakibara | 112/103 |

FOREIGN PATENT DOCUMENTS

| | | | |
|---|---|---|---|
| 1033262 | 2/1989 | Japan . | |
| 1260052 | 10/1989 | Japan | 112/103 |
| 3130456 | 6/1991 | Japan | 112/103 |
| 2125073 | 2/1984 | United Kingdom | 112/103 |

*Primary Examiner*—Ismael Izaguirre
*Attorney, Agent, or Firm*—Richard C. Litman

[57] ABSTRACT

A hoop attachment assembly for accurately and securely mounting an embroidery hoop frame to an automatically controlled hoop guide of an embroidery machine. The hoop attachment assembly includes a hoop attachment bracket which is mounted to the embroidery hoop. At least two resilient pins are attached to the hoop attachment bracket and are spaced apart to receive the hoop guide attachment bracket. The two resilient pins cooperatively squeeze and retain the hoop guide attachment bracket when the hoop attachment assembly is attached to the hoop guide attachment bracket.

11 Claims, 6 Drawing Sheets

EMBROIDERY HOOP ATTACHMENT ASSEMBLY

CROSS REFERENCE TO RELATED APPLICATION

This application is a Continuation in Part of Ser. No. 08/394,900, filed Feb. 27, 1995.

BACKGROUND OF THE INVENTION

1. Field of the Invention

This invention relates to automated embroidery operations. More specifically, the present invention relates to an embroidery hoop and the bracket for mounting an embroidery hoop on the hoop guide of an embroidery machine.

2. Description of the Prior Art

Embroidery commonly enhances the decorative appearance of a wide range of items. Typically, the embroidering is imparted on a workpiece by automated embroidery machines. The workpiece is mounted on any number of hoops, each hoop in turn being mounted on an automatically controlled hoop guide, also known as the X-Y driver, of an embroidery machine. The hoop guide moves the hoop relative to the needle of the embroidery machine as the needle introduces stitching to the workpiece. To ensure an accurate embroidery design, especially during mass production, the hoop must attach securely and precisely to the hoop guide. Unfortunately, repeated mounting and removing of the hoop wears the hoop attachment bracket, degrading the resolution of the stitching imparted on the fabric. For this reason, there is a need for an embroidery hoop attachment bracket which provides for secure and precise mounting of the embroidery hoop to the automatically controlled hoop guide of an embroidery machine by reducing wear on the hoop attachment bracket.

U.S. Pat. No. 5,291,843, issued Mar. 8, 1994, to Masayaki Hori, describes an attachment structure, shown in FIGS. 1 and 2, for detachably attaching an embroidery hoop to the automatically controlled hoop guide of an embroidery machine. A hoop 10 for holding a workpiece and hoop attachment bracket 12 are shown in FIG. 1. A hoop guide bracket 14 designed to matingly receive the hoop attachment bracket 12 is seen in FIG. 2. The hoop guide attachment bracket 14 is mounted to an automatically controlled hoop guide (not shown). The '843 attachment structure, including both the hoop attachment bracket 12 and the hoop guide attachment bracket 14, removably attaches the hoop 10 to the hoop guide such that the hoop can be moved by the hoop guide in a horizontal plane in synchronism with the reciprocating motion of the sewing needle of a sewing machine (not shown).

When the hoop attachment bracket 12 is removably attached to the hoop guide-attachment bracket 14, each of the two engagement pins 16 extending from the hoop attachment bracket 12 is closely received in a tight friction fit by a corresponding U-shaped slot 18 in the upturned flange portion 33 of the hoop guide attachment bracket 14. A spring clip 24 of the hoop guide attachment bracket 14 is articulated back such that the projection member 20 of the hoop attachment bracket 12 clears a knuckle portion 22 of the spring member 24. Once the hoop 10 is seated, the spring member 24 is released, biasing the projection member 20 and the hoop 10 downwardly. The spring member 24 and the engagement pins 16 act to maintain the hoop 10 stationary relative to the hoop guide.

During large-scale embroidery operations, thousands of hoops 10 are mounted and dismounted from the hoop guide. Unfortunately, repeated embroidery hoop installation results in excessive wear on the engagement pins 16 and their respective slots 18. As the engagement pins 16 and their respective slots 18 wear, the slots 18 no longer receive the engagement pins 16 in a tight friction fit as play develops between the engagement pins 16 and their respective slots 18. The resultant play causes the hoop 10 to move or wobble relative to the hoop guide, thereby dramatically effecting the resolution of the embroidery designs imparted on the workpiece. As a result, manufacturers must repair or replace hoops 10 or hoop attachment brackets 12 often.

Several other types of embroidery hoop attachment brackets are described in the patent literature. For example, U.S. Pat. No. 4,411,208, issued Oct. 25, 1983, to Koji Nishida et al., describes an embroidery frame for automatic embroidery machine. The apparatus includes a frame with a horizontal tang for an attachment. The tang is received in a slot in the machine and secured by threaded fasteners threadingly clamping the tang therein.

U.S. Pat. No. 5,101,746, issued Apr. 17, 1992, to Ricky J. Frye, describes a work holder for sewing machines. The device includes a frame with an attachment including two parallel posts extending outwardly, each having an annular groove distally disposed. Each post is received in a cylindrical bore of the machine. Radial, cylindrical chambers extend from the bores. Spring-loaded balls in the chambers are biased toward the bore and engage with the groove when the posts are inserted therein.

U.S. Pat. No. 5,261,340, issued Nov. 16, 1993, to Ralph F. Conley, Jr. et al., describes a detachable template clamp having a removable sewing template. The apparatus includes a template with an attachment including two parallel throughbores. The machine has an adaptor which traps the frame adaptor against guide rails. The machine adaptor has two posts extending toward the guide rails that are received in the frame adaptor throughbores.

U.S. Pat. No. 5,353,725, issued Oct. 11, 1994, to Hisato Sakakibara, describes front and rear embroidery frame mounting members. The apparatus includes a front and a rear attachment. The machine has a rear attachment including a flattened, C-shaped member having a vertically disposed slot. The frame has a horizontal flange with a vertical pin extending therefrom that is received by the machine attachment. The machine has a front attachment including a vertical pin. The frame has an attachment including a horizontal flange having a vertical throughbore for receiving the vertical pin.

Japanese Patent No. 1,033,262, published Feb. 3, 1989, issued to Aisin Seiki KK, in the abstract describes a machine including a fixed magnet. The frame includes a metal plate. The frame may be selectably fixed to the machine by magnetic adhesion. A problem encountered with the '262 machine is that the magnet can be easily dislodged if the frame is bumped during embroidery. Also, when heavier objects are embroidered, the frame tends to disengage from the machine.

None of the above references, taken alone or in combination, are seen as teaching or suggesting the presently claimed embroidery hoop attachment assembly.

SUMMARY OF THE INVENTION

The present invention overcomes the limitations of the above described inventions by providing a hoop attachment assembly for accurately and securely mounting an embroidery hoop to an automatically controlled hoop guide of an embroidery machine. The hoop attachment assembly includes a hoop attachment bracket which is mounted to the embroidery hoop. At least two resilient pins are attached to the hoop attachment bracket and are spaced apart to receive the hoop guide attachment bracket. The two resilient pins cooperatively squeeze and retain the hoop guide attachment bracket when the hoop attachment assembly is attached to the hoop guide attachment bracket.

In accordance with another aspect of the invention, a locking means is provided to inhibit vertical movement of the hoop attachment assembly relative to the hoop guide attachment bracket when the hoop attachment assembly is attached to the hoop guide attachment bracket.

In accordance with a further aspect of the invention, the hoop attachment bracket may include an aperture extending therethrough. The aperture is positioned in registry with a detent in the hoop guide attachment bracket. The first end of the aperture is positioned proximate to the front face of the hoop attachment bracket, and the second end of the aperture is threaded for receipt of a screw.

In accordance with still another aspect of the invention, the locking means may include a locking ball positioned in the aperture at the first end, a set screw positioned in the aperture at the second end, and biasing means for biasing the locking ball. The locking ball engages the detent of the hoop guide attachment bracket when the hoop attachment assembly is attached to the hoop guide attachment bracket. The set screw engages the threading at the second end of the aperture and permits adjustment of said locking ball relative to the hoop guide attachment bracket. The biasing means biases, i.e. forces, the locking ball into engagement with the detent when the hoop attachment assembly is attached to the hoop guide attachment bracket.

In accordance with another aspect of the invention, the hoop attachment bracket may be in the shape of a rectangular parallelpiped having a longitudinal axis, a top face, a bottom face, a front face, and a first end and a second end. The top face, the bottom face, and the front face extend in a direction parallel to the longitudinal axis between the first end and the second end.

In accordance with a further aspect of the invention, the hoop attachment bracket may be attached to a flat peripheral portion of the embroidery hoop in a manner such that the bottom face lies flush against the flat peripheral portion of the embroidery hoop.

In accordance with in another aspect of the invention, the hoop attachment bracket may include a first cut-away portion extending between the first end and the second end of the hoop attachment bracket to accommodate a raised edge at the periphery of the flat peripheral portion of the embroidery hoop. The first cut-away portion is formed by cutting away a corner of the parallelpiped at which the bottom face and the front face would otherwise join.

In accordance will still another aspect of the invention, the hoop attachment bracket may include a slot extending parallel to the front face. The slot includes a first side distal from the front face and a second side proximal the front face. The two pins extend from at least the first side to the front face.

In accordance with a further aspect of the invention, a portion of the hoop attachment bracket between the first side of the slot and the front face may be cut away to form a second cut-away portion. The second cut-away portion is in the shape of a rectangle when viewed facing the front face. Each of the two pins are positioned at opposing ends of the second cut-away portion.

In accordance with a still another aspect of the invention, a portion of the hooped attachment bracket between a plane, coincident with the first side of the slot, and the front face may be cut away to form a third cut-away portion. The third cut-away portion extends from the top face to intersect the bottom of the slot and the second cut-away portion at substantially the middle of the second cut-away portion. The third cut-away portion accommodates the spring clip of the hoop guide attachment bracket when the hoop attachment assembly is attached to the hoop guide attachment bracket.

In accordance with one aspect of the invention, the hoop attachment bracket may include a plurality of openings extending at least from the first side of the slot to the front face of the hoop attachment bracket. Each of the plurality of openings receives a first end of a respective one of the pins and is dimensioned to allow clearance between the side walls of the openings and the first end of a respective one of the pins. Thus, the side walls of each of the openings prevent over-deflection of a respective one of the pins when the hoop attachment assembly is attached to the hoop guide attachment bracket.

In consideration of the above, an object of the invention is to provide a embroidery hoop attachment bracket that assures secure mounting of an embroidery hoop on an embroidery machine.

Another object of the invention is to provide a embroidery hoop attachment bracket that is wear resistant.

A further object of the invention is to provide a embroidery hoop attachment bracket requiring minimum clearance for mounting onto an embroidery machine.

An additional object of the invention is to provide a embroidery hoop attachment including means for urging the frame mount to remain on the hoop guide attachment bracket.

Yet a further object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 3:
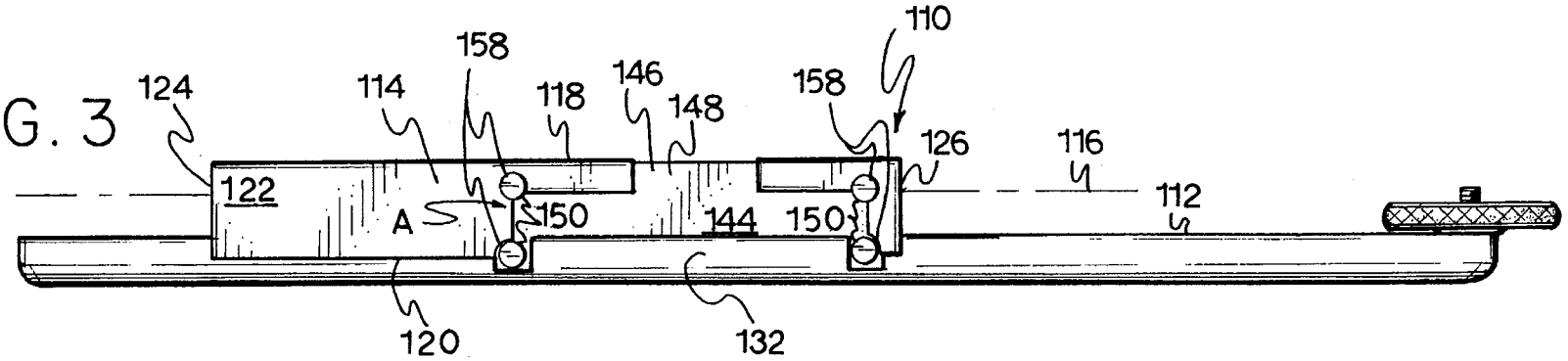
FIG. 3 is a front elevational view of the present invention.
Figure 4:
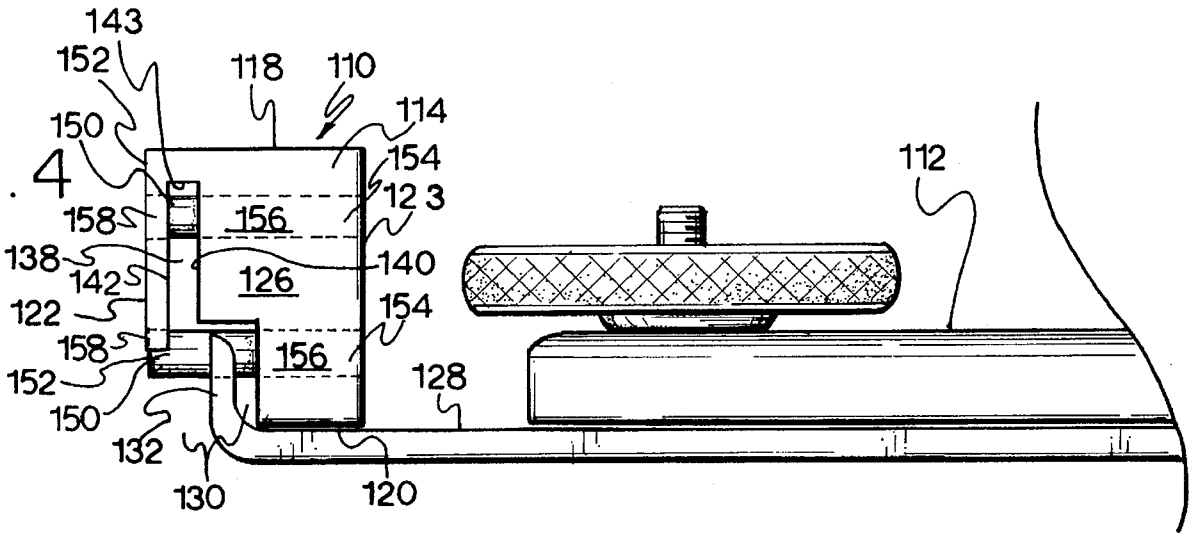
FIG. 4 is a side elevational view of the present invention, drawn to an enlarged scale.
Figure 5:
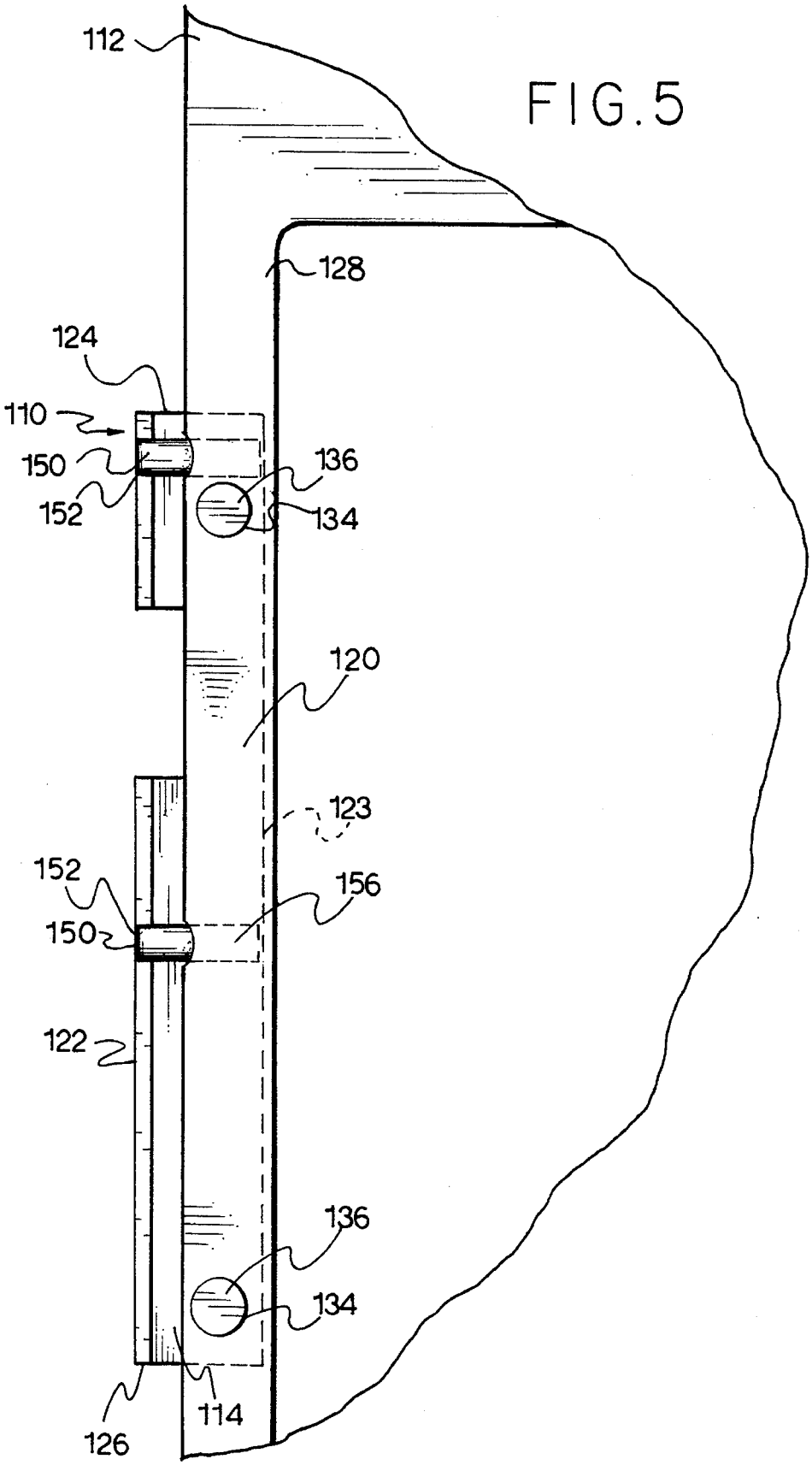
FIG. 5 is a partial, bottom plan view of the instant hoop attachment.

Referring to FIGS. 3–5, an embroidery hoop attachment assembly 110 for attaching an embroidery hoop to a hoop guide of an embroidery machine is shown mounted on an embroidery hoop 112. The embroidery hoop 112 is the subject of a pending application (Ser. No. 08/394,900, filed Feb. 27, 1995) by the present inventor which is incorporated herein by reference. Alternatively, embroidery hoop attachment assembly 110 may be used with any well known embroidery hoop.

Continuing to refer to FIGS. 3–5, the embroidery hoop attachment assembly 110 includes a hoop attachment bracket 114. The hoop attachment bracket 114 is formed in the shape of a rectangular parallelpiped having a longitudinal axis 116, a top face 118, a bottom face 120, a front face 122, a rear face 123, and a first end 124 and a second end 126. The top face 118, the bottom face 120, the front face 122 and the rear face 123 extend in a direction parallel to the longitudinal axis between the first end 124 and the second end 126.

The hoop attachment bracket 114 is attached to a flat peripheral portion 128 of the embroidery hoop in a manner such that the bottom face 120 lies flush against the flat peripheral portion 128 of the embroidery hoop. The hoop attachment bracket 114 includes a first cut-away portion 130 extending between the first end 124 and the second end 126 of the hoop attachment bracket 114 to accommodate a raised edge 132 at the periphery of the flat peripheral portion 128 of the embroidery hoop 112. The first cut-away portion 130 is formed by cutting away a corner of the parallelpiped at which the bottom face 120 and the front face 118 would otherwise join. Two parallel apertures 134, seen in FIG. 5, extend through the hoop attachment bracket 114 perpendicular to the longitudinal axis 116 and accommodate rivets 136 for fastening the hoop attachment bracket 114 to the embroidery hoop 112. Alternatively, any well known fastening means may be used to fasten the hoop attachment bracket 114 to the embroidery hoop 112.

Referring to FIG. 4, the hoop attachment bracket 114 includes a slot 138 extending parallel to the front face 122. The slot include a first side 140 distal from the front face 122 and a second side 142 proximal the front face 122. The slot also includes a bottom 143.

Referring to FIG. 3, a portion of the hoop attachment bracket 114 between the first side 140 of the slot 138 and the front face 122 is cut away to form a second cut-away portion 144. The second cut-away portion 144 is in the shape of a rectangle when viewed facing the front face 122.

Continuing to refer to FIG. 3, a portion of the hoop attachment bracket 114 between a plane 146, coincident with the first side 140 of the slot 138, and the front face 122 may be cut away to form a third cut-away portion 148. The third cut-away portion 148 extends from the top face 118 to intersect the bottom 143 of the slot 138 and the second cut-away portion 144 at substantially the middle of the second cut-away portion 144.

Referring again to FIGS. 3–5, the hoop attachment assembly 110 includes four flexible, resilient pins 150 which extend perpendicularly to the longitudinal axis 116 from the rear face 123 to the front face 122 of the hoop attachment bracket 114. Each of the pins 150 is positioned a respective corner of the of the second cut away portion 144. The pins 150 are preferably of nylon construction. However, the pins 150 may be formed from any flexible, resilient material which would allow the resilient pins to bend or deflect transverse to their longitudinal axis.

Each of the pins 150 include a first section 152 and a second section 154. A first plurality of openings 156 extends from the rear face 123 to the first side 140 of the slot 138 to receive the second section 154 of the pins 150 in a tight friction fit. The first section 152 of each of the pins 150 is thus free to bend or deflect transverse to its transverse axis, while the second section 154 of the pin 150 is held rigidly in place by the hoop attachment bracket 114. A second plurality of openings 158, each in registry with a corresponding opening of the first plurality of openings 156, extend from the first side 140 of the slot 138 to the front face 122 of the hoop attachment bracket 114. Each opening of the second plurality of openings 158 receives the first section 152 of a respective one the pins 150. Each of the second plurality of openings 158 is dimensioned to allow clearance between the first section 152 of a respective one of the pins 150 and the hoop attachment bracket 114. Thus, the hoop attachment bracket 114 acts as a collar by preventing over-deflection of the first section 152 of each of the pins 150. Preferably, the clearance between the hoop attachment bracket 114, at each opening of the second plurality of openings 158, and each of the pins 150 is less than 0.002 of an inch (0.005 mm).

Figure 7:
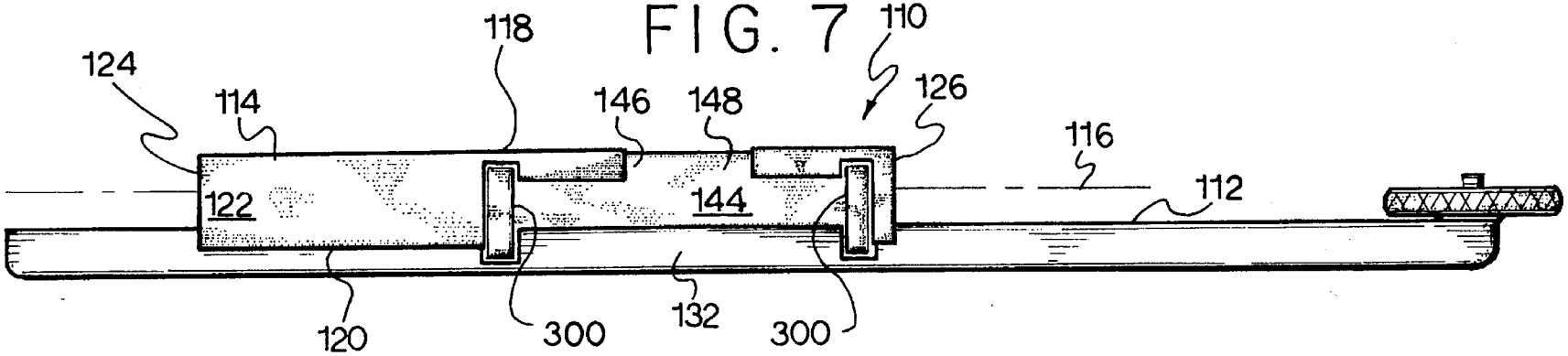
FIG. 7 is a front elevational view of a second embodiment of the present invention.

Referring to FIG. 7, a second embodiment of the hoop attachment bracket 112 is shown. Preferably, the hoop attachment bracket 112 is constructed of a die-cast metal block with the slot, openings, apertures, and cut-away portions being machined out of the die-cast metal block. More preferably, the entire hoop attachment 112 may be formed through the injection molding of plastic, or a similar material, with spring brackets 300 replacing the pins 150 and being formed integral with to the hoop attachment bracket 114.

Figure 1:
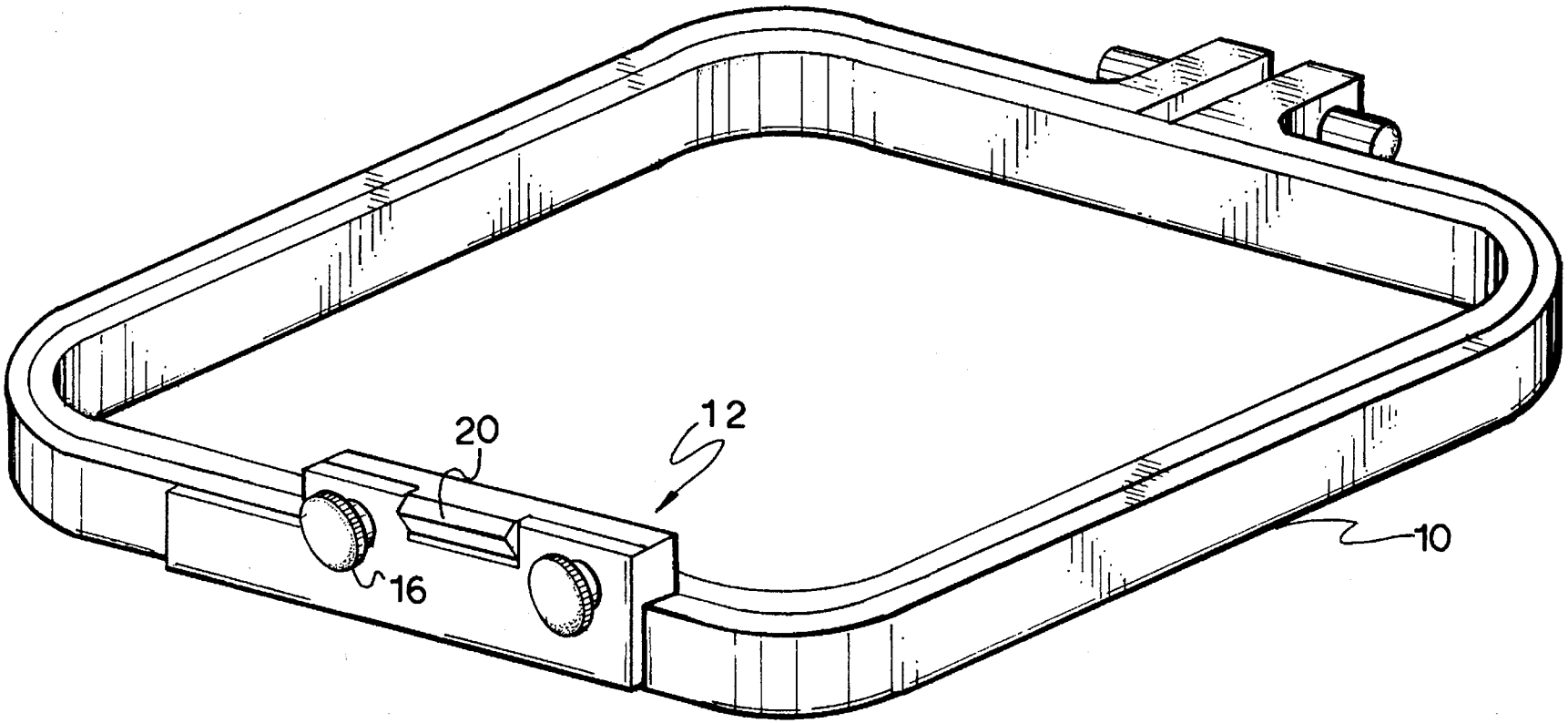
FIG. 1 PRIOR ART
FIG. 1 is an top front perspective view of a prior art hoop.
Figure 2:
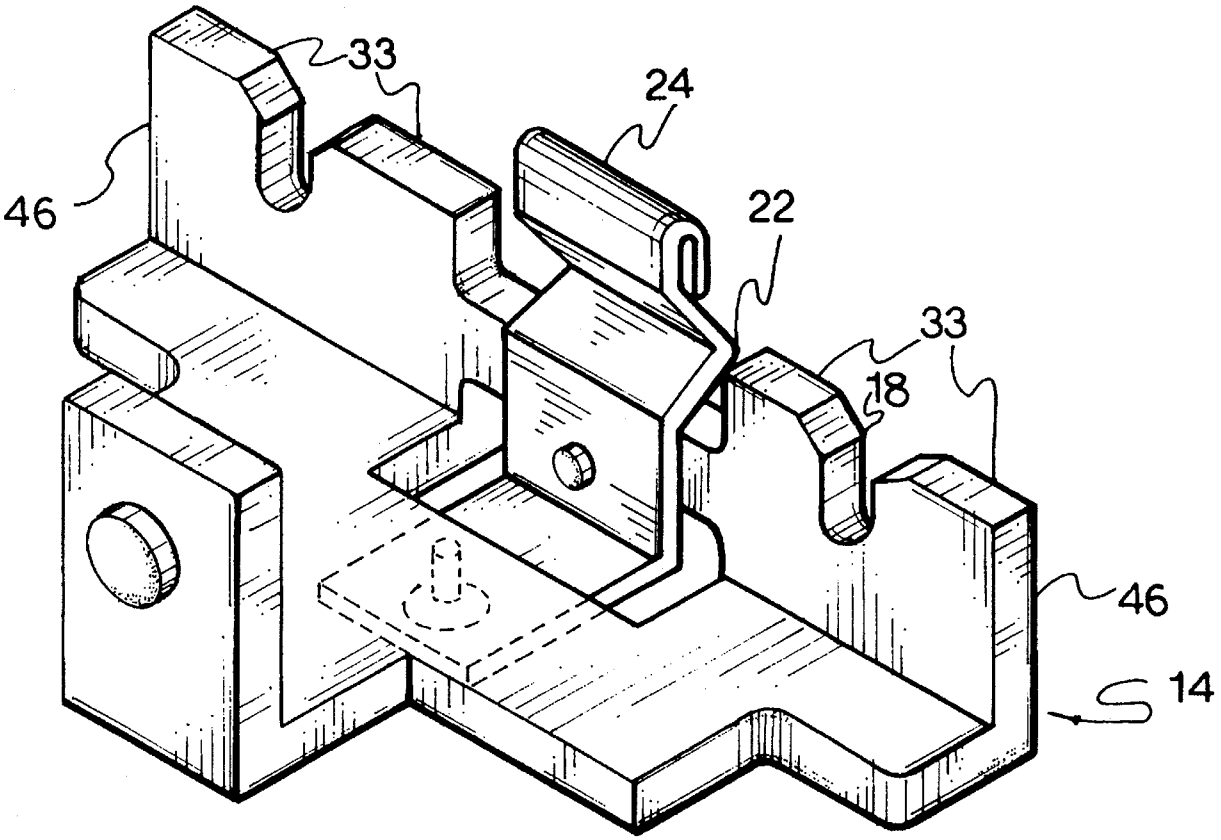
FIG. 2 PRIOR ART
FIG. 2 is a top rear perspective view of a prior art hoop guide attachment bracket.

The hoop attachment assembly 110 is designed to allow removable attachment of the embroidery hoop 112 to an automatically controlled hoop guide of an embroidery machine. The hoop attachment assembly receives a hoop guide attachment bracket, such as the bracket 14 shown in FIG. 2 and discussed above. The operation of the present invention, discussed in the context of the particular hoop guide attachment bracket 12 shown in FIG. 2, is for illustrative purposes only. One skilled in the art will appreciate that the hoop attachment assembly 110 can easily be configured to allow removable attachment of an embroidery hoop to the hoop guide attachment bracket of any well known embroidery machine.

Referring to FIGS. 2–5, in operation the hoop attachment bracket 114 is aligned above the hoop guide attachment bracket 14. The second-cut away portion 144 receives the upturned flange projection 33. Each of the first sections of the pins 150 flex and cooperatively squeeze the side edges 46 of the upturned flange projection 33, thereby retaining the hoop guide attachment bracket 14 within the second cut-away portion 114 of the hoop attachment bracket 114. The third cut-away portion 148 accommodates the spring clip 24 of the hoop guide attachment bracket 14 such that no portion of the spring clip 24 engages the hoop attachment assembly 110. Thus, spring clip 24 may be removed from the hoop guide attachment bracket 14 as it is no longer necessary to ensure the hoop attachment bracket 114 remains attached to the hoop guide attachment bracket 14.

One skilled in the art will appreciate that only two pins 150, positioned at opposite sides of the second cut-away portion 144, are necessary to retain the upturned flange projection 33 of the hoop guide attachment bracket 14 within the second cut-away portion 144.

Preferably, the distance between pins 150, shown by line A on FIG. 3, is less than the distance between the two side edges 46 of the upturned flange portion 14. Even more preferably, the distance between the pins 150 is 0.005 of inch (0.013 mm) or less than the distance between the two side edges 46 of the upturned flange portion 14.

The hoop attachment assembly 110 reduces wear on the hoop attachment bracket 114 and the hoop guide attachment bracket 14 by eliminating metal to metal contact between the brackets. Contact between the brackets is maintained primarily through the pins 150. Thus, a secure and precise mounting of the embroidery hoop 112 to the automatically controlled hoop guide is ensured even through repeated use of the embroidery machine.

Figure 6:
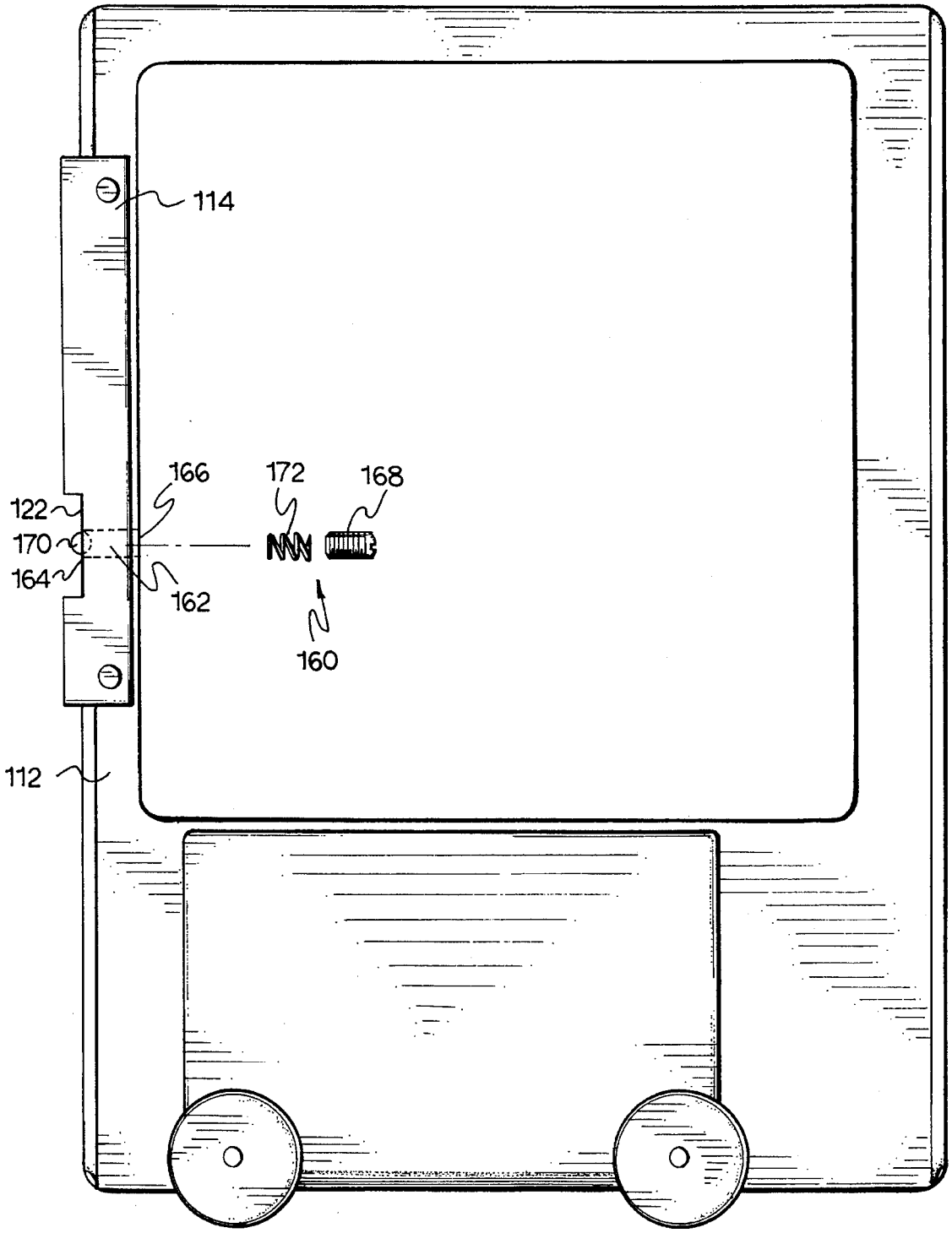
FIG. 6 is a top plan view of another embodiment of the invention including biased engagement means.

Referring to FIG. 6, a second embodiment of the hoop attachment assembly 110 is shown. Locking means 160 is a detent or spring-operated ball to inhibit vertical movement of the hoop attachment assembly 110 relative to the hoop guide attachment bracket 14 when the hoop attachment assembly is attached to the hoop guide attachment bracket 14. The hoop attachment bracket 114 includes a second aperture 162 extending completely therethrough. The second aperture 162 is positioned in registry with a detent (not shown) in the hoop guide attachment bracket 14. A first end 164 of the second aperture 162 is positioned at the front face 122 of the hoop attachment bracket 114 and a second end 166 of the second aperture 160 is threaded for receipt of a set screw 168. A locking ball 170 of the detent 160 is positioned within the second aperture 162 at the first end 164. The set screw 168 engages the threading within the second aperture 160 at the second end 166. The locking ball 170 engages the hoop guide attachment bracket 14 when the hoop attachment assembly 110 is attached to the hoop guide attachment bracket 14. The set screw 168 permits adjustment of the locking ball 170 relative to the second aperture 162. A spring 172 biases the locking ball 170 into engagement with the hoop guide attachment bracket 14 when the hoop attachment assembly 110 is attached to the hoop guide attachment bracket 14.

The present invention is not intended to be limited to the embodiments described above, but to encompass any and all embodiments within the scope of the following claims.

I claim:

1. An embroidery hoop attachment assembly for attaching an embroidery hoop to a hoop guide of an embroidery machine, the hoop guide including a hoop guide attachment bracket, said hoop attachment assembly comprising:

an embroidery hoop;

a hoop attachment bracket having a front face, said hoop attachment bracket being mounted to the embroidery hoop; and at least two resilient pins attached to said hoop attachment bracket, said at least two resilient pins being spaced apart to receive the hoop guide attachment bracket, said pins cooperatively squeezing and retaining the hoop guide attachment bracket when said hoop attachment assembly is attached to the hoop guide attachment bracket;

said hoop attachment bracket being in the shape of a rectangular parallelpiped having a longitudinal axis, a top face, a bottom face, a front face, and a first end and a second end, said top face, said bottom face, and said front face extending in a direction parallel to said longitudinal axis between said first end and said second end; and said hoop attachment bracket being attached to a flat peripheral portion of the embroidery hoop in a manner such that said bottom face lies flush against the flat peripheral portion of the embroidery hoop;

said hoop attachment bracket including a first cut-away portion extending between said first end and said second end to accommodate a raised edge at the periphery of the flat peripheral portion of the embroidery hoop, said first cut-away portion being formed at a corner of said parallelpiped.

2. The hoop attachment assembly according to claim 1, further including locking means to inhibit vertical movement of said hoop attachment assembly relative to the hoop guide attachment bracket when said hoop attachment assembly is attached to the hoop guide attachment bracket.

3. The hoop attachment assembly according to claim 2, wherein:

said hoop attachment bracket includes an aperture extending therethrough, said aperture having a first end and a second end, said first end of said aperture being proximate to said front face of said hoop attachment bracket, said second end of said aperture being threaded for receipt of a screw; and said locking means includes:

a locking ball positioned in said aperture at said first end, a set screw positioned in said aperture at said second end and engaging said threading, said set screw permitting adjustment of said locking ball, and biasing means biasing said locking ball.

4. An embroidery hoop attachment assembly for attaching an embroidery hoop to a hoop guide of an embroidery machine, the hoop guide including a hoop guide attachment bracket, said hoop attachment assembly comprising:

an embroidery hoop;

a hoop attachment bracket having a front face, said hoop attachment bracket being mounted to the embroidery hoop; and at least two resilient pins attached to said hoop attachment bracket, said at least two resilient pins being spaced apart to receive the hoop guide attachment bracket, said pins cooperatively squeezing and retaining the hoop guide attachment bracket when said hoop attachment assembly is attached to the hoop guide attachment bracket;

said hoop attachment bracket being in the shape of a rectangular parallelpiped having a longitudinal axis, a top face, a bottom face, a front face, and a first end and a second end, said top face, said bottom face, and said front face extending in a direction parallel to said longitudinal axis between said first end and said second end; and said hoop attachment bracket being attached to a flat peripheral portion of the embroidery hoop in a manner such that said bottom face lies flush against the flat peripheral portion of the embroidery hoop;

said hoop attachment bracket further includes a slot extending parallel to said front face, said slot having a first side distal from said front face and a second side proximal said front face, said at least two pins extending from at least said first side to said front face.

5. The hoop attachment assembly according to claim 4, wherein a portion of said parallelpiped between said first side of said slot and said front face being cut away to form a second cut-away portion, said second cut-away portion being in the shape of a rectangle when viewed facing said front face, said second cut-away portion having a middle, each of said at least two pins being positioned at opposing ends of said second cut-away portion.

6. The hoop attachment assembly according to claim 5, wherein a portion of said hoop attachment bracket between a plane coincident with said first side of said slot and said front face being cut away to form a third cut-away portion, said third cut-away portion extending from said top face to intersect said bottom of said slot and said second cut-away portion at substantially said middle of said second cut-away portion, said third cut-away portion for accommodating a spring clip of a hoop guide attachment bracket when said hoop attachment assembly is attached to the hoop guide attachment bracket.

7. The hoop attachment assembly according to claim 6, wherein said hoop attachment bracket includes a plurality of openings extending at least from said first side of said slot to said front face of said hoop attachment bracket, each of said plurality of openings receiving a first end of a respective one of said pins, each of said openings having side walls and being dimensioned to allow clearance between said side walls and said first end of a respective one of said pins, whereby said side walls of each of said plurality of openings prevent over-deflection of said respective one of said pins when said hoop attachment assembly is attached to the hoop guide attachment bracket.

8. An embroidery hoop attachment assembly for attaching an embroidery hoop to a hoop guide of an embroidery machine, the hoop guide including a hoop guide attachment bracket having a spring clip, said hoop attachment assembly comprising:

an embroidery hoop;

a hoop attachment bracket in the shape of a rectangular parallelpiped having a longitudinal axis, a top face, a bottom face, a front face, and a first end and a second end, said top face, said bottom face, and said front face extending in a direction parallel to said longitudinal axis between said first end and said second end, said hoop attachment bracket being attached to a flat peripheral portion of the embroidery hoop in a manner such that said bottom face lies flush against the flat peripheral portion of the embroidery hoop, said hoop attachment bracket having a first cut-away portion extending between said first end and said second end to accommodate a raised edge at the periphery of the flat peripheral portion of the embroidery hoop, said first cut-away portion being formed at a corner of said parallelpiped, said hoop attachment bracket further having a slot extending from said first end to said second end, said slot having a bottom, said slot being open proximate said first cut-away portion, said slot having a first side distal from said front face and a second side proximal said front face, a portion of said hoop attachment bracket between said slot and said front face forming a second cut-away portion, said second cut-away portion being in the shape of a rectangle when viewed facing said front face, said second cut-away portion having a middle, a portion of said hoop attachment bracket between a plane coincident with said first side of said slot and said front face forming a third cut-away portion, said third cut-away portion extending from said top face to intersect said bottom of said slot and said second cut-away portion at substantially said middle of said second cut-away portion; and first, second, third and fourth resilient pins, each of said pins positioned about a respective corner of said second cut-away portion, each of said pins extending at least between said first side and said from face, said pins for cooperatively squeezing and retaining a hoop guide attachment bracket, and said third cut-away portion for accommodating a spring clip of the hoop guide attachment bracket, when said hoop attachment assembly is attached to the hoop guide attachment bracket.

9. The hoop attachment assembly according to claim 8, wherein said hoop attachment bracket includes a plurality of openings extending at least from said first side of said slot to said front face of said hoop attachment bracket, each of said plurality of openings receiving a first end of a respective one of said pins, each of said openings having side walls and being dimensioned to allow clearance between said side walls and said first end of a respective one of said pins, whereby said side walls of each of said plurality of openings prevent over-deflection of said respective one of said pins when said hoop attachment assembly is attached to the hoop guide attachment bracket.

10. The hoop attachment assembly according to claim 8, further including locking means to inhibit vertical movement of said hoop attachment assembly relative to said hoop guide attachment bracket when said hoop attachment assembly is attached to the hoop guide attachment bracket.

11. The hoop attachment assembly according to claim 10, wherein:

said hoop attachment bracket includes an aperture extending therethrough, said aperture having a first end and a second end, said first end of said aperture being proximate said front face of said hoop attachment bracket, said second end of said aperture being threaded; and said locking means includes:

a locking ball positioned in said aperture at said first end a set screw positioned in said aperture at said second end and engaging said threading, said set screw permitting adjustment of said locking ball relative to said aperture, and biasing means biasing said locking ball.

* * * * *